US005704306A

United States Patent [19]

Den Ouden

[11] Patent Number: 5,704,306

[45] Date of Patent: Jan. 6, 1998

[54] STERN SCREW FOR A VESSEL AS WELL AS A VESSEL PROVIDED WITH SUCH A STERN SCREW

[75] Inventor: Willem Hendrik Den Ouden, Antwerpen, Belgium

[73] Assignee: Vetus Den Ouden N.V., Schiedam, Netherlands

[21] Appl. No.: 573,037

[22] Filed: Dec. 15, 1995

[30] Foreign Application Priority Data

Dec. 16, 1994 [NL] Netherlands ..... 9402140

[51] Int. Cl.[6] ..... B63H 11/00

[52] U.S. Cl. ..... 114/151; 440/38

[58] Field of Search ..... 440/38, 39, 40, 440/41, 42, 43, 44, 45, 46, 47; 114/150, 151

[56] References Cited

U.S. PATENT DOCUMENTS

| | | | |
|---|---|---|---|
| 2,997,015 | 8/1961 | Richter . | |
| 3,127,865 | 4/1964 | Pleuger | 114/151 |
| 3,487,805 | 1/1970 | Satterthwaite et al. . | |
| 3,593,686 | 7/1971 | Cooper | 114/151 |
| 3,792,938 | 2/1974 | Wilde . | |
| 4,208,978 | 6/1980 | Eller | 114/151 |
| 4,789,302 | 12/1988 | Gruzling . | |
| 4,884,985 | 12/1989 | Dyrkorn | 114/151 |
| 5,140,926 | 8/1992 | Denston | 114/151 |

FOREIGN PATENT DOCUMENTS

| | | |
|---|---|---|
| 1514519 | 2/1968 | France . |
| 39 35 754 | 5/1991 | Germany . |

*Primary Examiner*—Stephen Avila
*Attorney, Agent, or Firm*—Young & Thompson

[57] ABSTRACT

A stern screw has a tunnel tube inside which a propeller is rotatable about a shaft. The propeller is driven by a drive motor at least during operation. The stern screw is placed entirely below water level. For this purpose, the tunnel tube has an opening for accommodating therein an intermediate part which is profiled at a first side, forming part of the wall of the tunnel tube, and at an opposite side is provided with a flange for fastening to an outside of a stern of the boat. The intermediate part has a cavity in which a drive shaft is accommodated by which the propeller is driven. The drive motor is mounted in its entirety on the inside of the stern.

8 Claims, 2 Drawing Sheets

STERN SCREW FOR A VESSEL AS WELL AS A VESSEL PROVIDED WITH SUCH A STERN SCREW

BACKGROUND OF THE INVENTION

1. Field of the Invention

The invention relates to a stern screw for a boat comprising a tunnel tube in which a propeller is provided with rotation possibility about a shaft, which propeller is driven by a drive motor at least during operation.

2. Description of the Related Art

A stern screw is arranged at the rear side, or stern, of a boat and provides a propulsion of the boat transverse to its longitudinal direction. The boat can thus be manoeuvred much more easily than a boat provided solely with a main screw for forward propulsion, in which case manoeuvring is effected by means of the rudder only.

A known stern screw is incorporated in a completely watertight housing of stainless steel which is mounted against the rear side or stern of the boat. Said housing comprises on the one hand the tunnel tube, but on the other hand also the drive motor and must on that account project partly above the water line. This is not only visually unattractive, but it also hampers the placement of a swimming platform. In addition, the manufacture of such a housing, which is often bulky, is comparatively expensive because the housing must be made entirely of corrosion-resistent material (stainless steel) and must be continually tested for leakproofness. Owing to the leakproofness of the housing, moreover, virtually no ventilation will be possible therein, so that any condensation cannot be removed, which may lead to corrosion after all in the long run.

SUMMARY OF THE INVENTION

The present invention has for its object inter alia to provide a stern screw of the kind mentioned in the opening paragraph in which said disadvantages and drawbacks are counteracted.

According to the invention, a stern screw of the kind mentioned in the opening paragraph is for this purpose characterized in that the tunnel tube comprises an opening for receiving therein an intermediate part, in that the intermediate part is profiled at a first side for forming a portion of the inner wall of the tube and is provided with a flange at a second side for fastening to an outer side of a stern of the boat, and in that the intermediate part comprises a cavity in which a drive shaft is accommodated which is coupled to the propeller at one side and to the drive motor at the other side, said drive motor being placed at an inner side of the stern.

Since the drive motor is placed in the interior of the boat with such a stern screw, the entire stern screw may be provided below the water line so that the presence of the stern screw no longer forms an obstacle to the placement of a swimming platform and is no longer visually unattractive. The intermediate part ensures, possibly in combination with a suitable gasket, a watertight mounting of the tunnel tube with the propeller inside against the stern of the boat. The drive motor of the stern screw according to the invention is present in its entirety inside the boat and is accordingly always accessible for maintenance while requiring no special anti-corrosion measures.

To provide an increased propelling force of the stern screw, the tunnel tube thereof in a preferred embodiment of the stern screw according to the invention comprises flared ends. The inlet and outlet openings of the tunnel tube are widened thereby, so that more water can be displaced. An optimum propelling force is found to be achieved here in a special embodiment wherein the flared ends each terminate in a flange which extends transversely to the longitudinal direction of the tunnel tube. Such a stern screw has proved itself capable of providing a particularly great propelling force in practice.

To facilitate maintenance of the stern screw in a special embodiment of the stern screw according to the invention, the drive motor is detachably mounted to a side of the intermediate part which faces away from the tunnel tube. Especially if, as is usual, a so-called shear pin (weak link) is used in the drive shaft of the propeller, the drive shaft may be readily revised in the case of jamming of the propeller now without the necessity of taking the boat from the water.

The tunnel tube may be made from any suitable material, but it preferably comprises a corrosion-resistent material such as stainless steel, aluminium or synthetic resin. Any remaining, less corrosion-resistent metal parts in the water side of the stern screw are preferably provided with a zinc anode for protection against corrosion. provide an adequate steering performance, the stern screw according to the invention preferably comprises a specially shaped propeller with a substantially symmetrical propulsion characteristic in relation to its direction of rotation. The propelling force of the stern screw is then substantially the same in clockwise and anti-clockwise direction.

The invention further relates to a boat provided with a stern screw according to the invention, which boat according to the invention is characterized in that the stern screw is placed against the stern of the boat such that a centreline of the tunnel tube is at least half a tunnel tube diameter above the bottom of the boat and at least a full tunnel tube diameter below the water line. It is found in practice that a stern screw at this minimum depth below the water line has the highest efficiency while its positioning above the bottom of the boat influences the hydrodynamic resistance of the boat as little as possible, so that speed losses are reduced to a minimum.

BRIEF DESCRIPTION OF THE DRAWINGS

The invention will now be explained in more detail with reference to an embodiment and a drawing, in which.

DESCRIPTION OF THE PREFERRED EMBODIMENT

Figure 1:
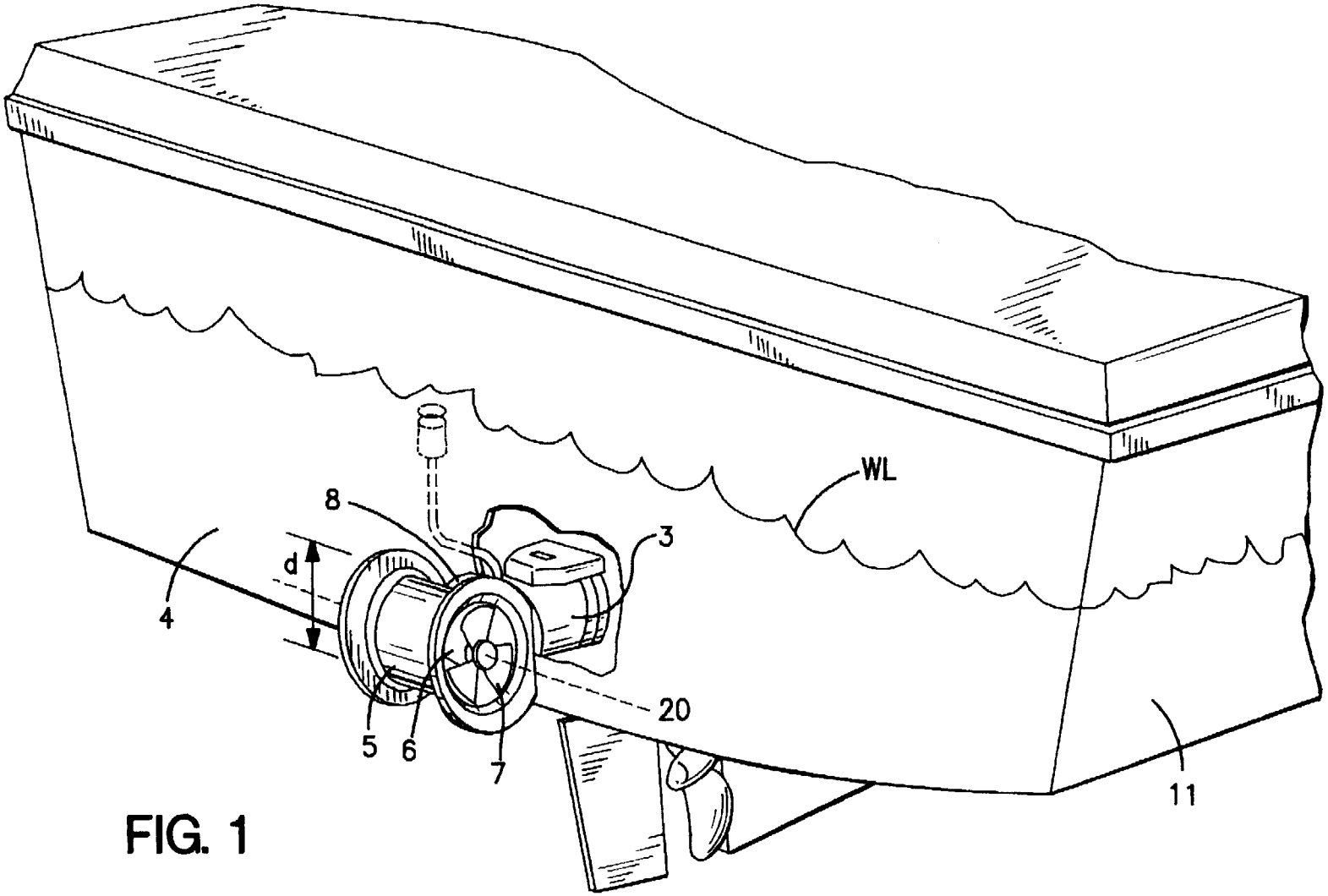
FIG. 1 is a perspective view of a boat according to the invention provided with a corresponding stern screw.

The Figures are purely diagrammatic and not always true to scale. Some dimensions have been particularly exaggerated for reasons of clarity. Corresponding parts have been given the same reference numerals in the Figures as much as possible.

FIG. 1 shows the rear of a boat, for example a yacht or motor vessel, provided with a stern screw according to the invention which is mounted against the stern 4 of the boat. The stern of the boat can be moved to starboard or port by means of the stern screw, also when the boat lies almost or completely still, whereby manoeuvring of the is made much easier. A similar effect can be achieved at the bow through the use of a bow screw.

The stern screw comprises a tunnel tube 5 in which a propeller 7 is mounted with rotation possibility about a shaft which is coupled via a dog 6 to an electric drive motor 3 provided with a switch-on relay. According to the invention, a centreline 20 of the tunnel tube lies at least one half tunnel tube diameter d above the bottom 11 of the boat and at least one full tunnel tube diameter below the water line WL. Such a placement of the tunnel tube, well below the water line, is found to benefit the propelling force of the stern screw in practice while at the same time the stern screw does not form an impediment in this way if it should be desired to mount a swimming platform against the stern. In addition, the entire stern screw is now hidden from view so that it does not detract from the boat's appearance, unlike the known rotor. Since the stern screw does not project below the ship in this embodiment, the hydrodynamic resistance, and consequently the speed of the boat are hardly influenced by the presence of the stern screw.

Figure 2:
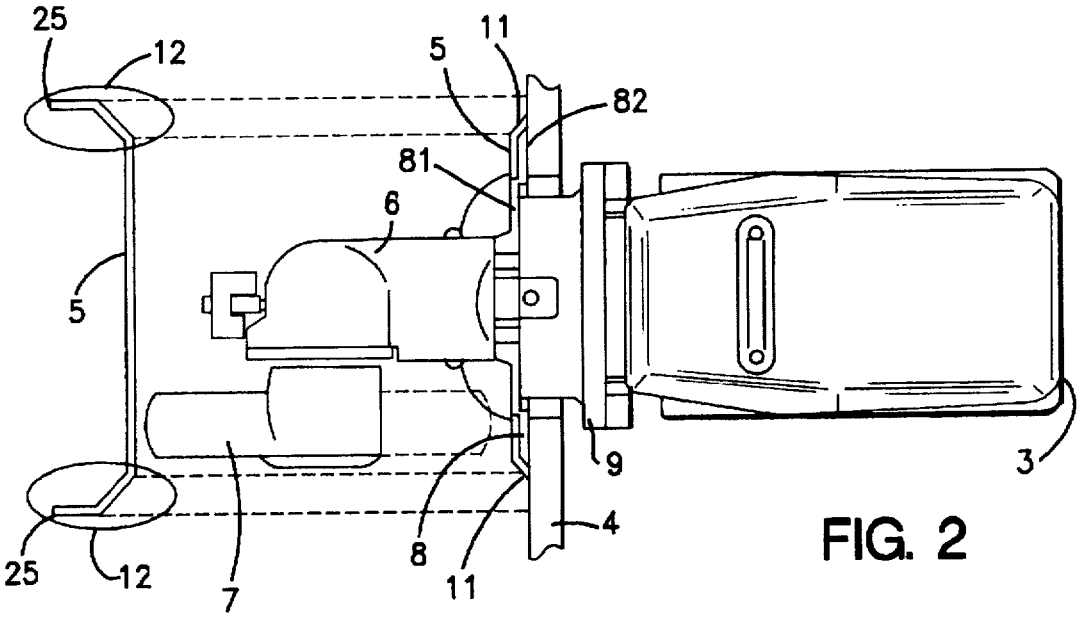
FIG. 2 is a first cross-section of an embodiment of the stern screw according to the invention.
Figure 3:
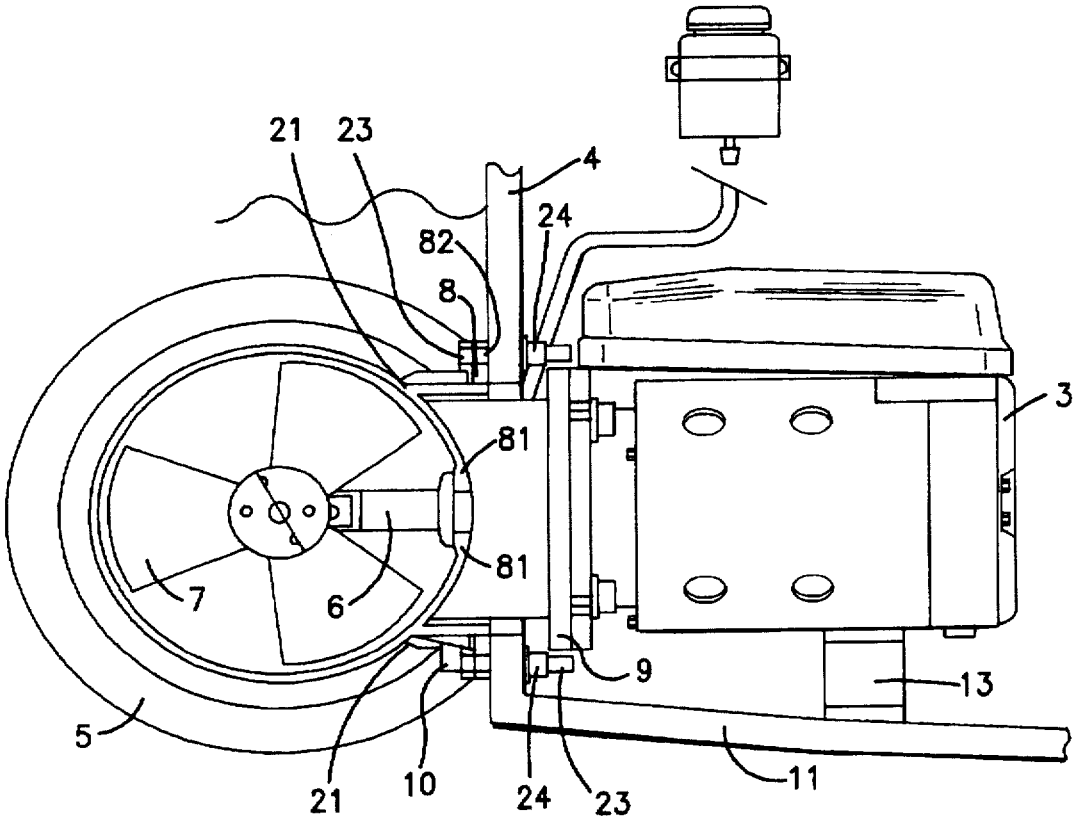
FIG. 3 is a second cross-section, perpendicular to the first, of the stern screw of FIG. 2.

An embodiment of the stern screw according to the invention is shown in more detail in cross-section in FIG. 2. FIG. 3 is a second cross-sectional view taken in a plane perpendicular to that of the cross-section of FIG. 2. The entire drive motor 3 is placed inside the boat here, while the tunnel tube 5 with the dog 6 and propeller 7 are arranged at the water side of the stern 4. The tunnel tube 5 according to the invention is provided with an opening 21 for receiving therein an intermediate part 8 to realize such a construction. The intermediate part 8 has a concave round profile at a first side 81, thus forming part of an inner wall of the tunnel tube, while comprising a flange 82 at the other side by means of which the intermediate part itself together with the tunnel tube 5, dog 6, and propeller 7 is fastened to the water side of the stern. To this end, a number of bores is circumferentially provided in the flange and the stern, so that the intermediate part can be mounted with a corresponding number of bolts 23 and nuts 24. If so desired, a suitable gasket may be interposed between the flange 82 and the stern 4 to ensure watertightness. The dog 6 with propeller 7 and tunnel tube 5 are fastened to the intermediate part. The intermediate part further comprises a number of zinc anodes at the water side for protecting the part against corrosion. Such an anode 10 is also present on the metal dog 6. The propeller itself is made from synthetic resin and is thus corrosion-resistent. A special propeller shape is used in this embodiment with an at least substantially symmetrical propulsion characteristic in relation to the direction of rotation. The stern screw as a result has a substantially identical steering behaviour to starboard and port.

For easier maintenance, the electric motor 3 is fastened to the inside of the stern 4 and is detachably connected to the external parts of the stern screw by means of nuts and bolts via an interposed flange 9 which is passed through an opening in the stern 4. The intermediate part 8 and the interposed flange 9 enclose a central cavity in which the output shaft of the electric motor is accommodated and coupled to the propeller 7 via dog 6. A support 13 is provided below the electric motor 3 to bear the usually considerable weight thereof and thus take the load off the stern screw.

The tunnel tube 5 in this embodiment is of a special shape, i.e. its ends are flared out and terminate each in a flange 25 which extends transversely to the longitudinal direction of the tube 5. Such a flared shape at the ends of the tunnel tube widens the effective inlet and outlet openings, which increases the efficiency, and a considerable propelling force is achieved even with a comparatively short tunnel tube. The length of the tunnel tube 5 is such, moreover, that the water flow path length inside the tunnel tube 5 is practically ideal. A gain in propelling force of 40–50% was achieved in practice with a tunnel tube 5 of this shape. The tunnel tube may be moulded/cast, for example, from synthetic resin, such as polyester, or from aluminium, whereby the desired shape may be readily realized. The tunnel tube is not only corrosion-resistent owing to the use of said materials but also comparatively light in weight.

Not only does the tunnel tube 5 increase the efficiency of the stern screw by some 20%, it also provides the propeller with an adequate screening. A rotating propeller would otherwise form a major injury risk for a swimmer or someone who had inadvertently fallen overboard if his/her limbs, for example, were to come into contact with the propeller. Furthermore, the tube dampens the noise of the propeller.

Although the invention was described in detail above with reference to only a single embodiment, it will be obvious that the invention is by no means limited to the example given. On the contrary, many more variations and designs are possible to those skilled in the art within the scope of the invention.

In general terms, the invention offers a particularly powerful stern screw and a boat provided therewith whose outward appearance is not impaired by the presence of the rotor, while the latter in addition does not present an obstacle to the placement of a swimming platform or something similar at the rear of the boat.

I claim:

1. A stern screw for a boat comprising a stationary tunnel tube in which a propeller is provided which rotates about a shaft in said stationary tunnel tube, which propeller is driven by a drive motor at least during operation, wherein the tunnel tube has an inner cylindrical surface extending in a longitudinal axis direction, and an opening which extends through said tunnel tube in a direction transverse to said axis, said opening receiving therein an intermediate part, the intermediate part extending into said opening and comprising a first side which includes a partially cylindrical surface which adjoins said inner cylindrical surface and is configured and dimensioned to combine with said inner cylindrical surface to form said tunnel tube, said intermediate part being provided with a flange at a second side for fastening to an outer side of a stern of the boat, said flange comprising a first length extending from said first side in a direction substantially transverse to said axis, and a second length extending from said first length in a direction substantially parallel to said axis, and said intermediate part comprising a cavity in which a drive shaft is accommodated which is coupled to the propeller at one side and to the drive motor at the other side, said drive motor being placed at an inner side of the stern.

2. A stern screw as claimed in claim 1, wherein the tunnel tube is flared out at its ends.

3. A stern screw as claimed in claim 2, wherein the flared ends of the tunnel tube each terminate in a flange which extends transversely to a axis of the tunnel tube.

4. A stern screw as claimed in any claim 1, wherein the drive motor is detachably mounted to a side of the intermediate part which faces away from the tunnel tube.

5. A stern screw as claimed in any claim 1, wherein metal parts in the tunnel tube are provided with zinc anodes.

6. A stern screw as claimed in any claim 1, wherein the tunnel tube is manufactured from a corrosion-resistent material such as stainless steel, aluminium or synthetic resin.

7. A stern screw as claimed in claim 1, wherein said propeller is substantially symmetrical in propulsion characteristics in relation to its direction of rotation.

8. A boat provided with a stern screw as claimed in claim 1, wherein the stern screw is placed against a stern of the boat such that a centerline of the tunnel tube is at least half a tunnel tube diameter above the bottom of the boat and at least a full tunnel tube diameter below the water line.

* * * * *